United States Patent [19]

Peterson

[11] Patent Number: 4,670,941

[45] Date of Patent: Jun. 9, 1987

[54] DOOR HINGE WITH AN ANNULAR ELASTOMERIC CHECK

[75] Inventor: Lawrence D. Peterson, Southfield, Mich.

[73] Assignee: Ford Motor Company, Dearborn, Mich.

[21] Appl. No.: 808,918

[22] Filed: Dec. 13, 1985

[51] Int. Cl.[4] ..... E05D 11/10; E05F 5/02

[52] U.S. Cl. ..... 16/332; 16/86 R; 16/333; 16/334

[58] Field of Search ..... 16/85, 86 R, 86 C, 86 A, 16/50, 225, 232, 257, 262, 270, 286, 292, 297, 319, 321, 327, 333, 334, 344, 345, 348, 352, 375

[56] References Cited

U.S. PATENT DOCUMENTS

| | | | |
|---|---|---|---|
| 536,701 | 4/1895 | Peck | 16/334 |
| 1,015,209 | 1/1912 | Richardson | 16/270 |
| 1,694,764 | 12/1928 | Beringer . | |
| 2,290,331 | 7/1942 | Jacobs | 16/86 C |
| 3,000,049 | 9/1961 | Terry, Jr. . | |
| 3,643,289 | 2/1972 | Lohr | 16/327 |
| 3,820,192 | 6/1974 | Nakano et al. . | |
| 4,090,273 | 5/1978 | Hurst, Jr. . | |
| 4,237,577 | 12/1980 | Chapel | 16/262 |
| 4,329,759 | 5/1982 | Lautenschlager . | |
| 4,446,596 | 5/1984 | Arlaukas . | |

*Primary Examiner*—Fred Silverberg

*Attorney, Agent, or Firm*—Jerome R. Drouillard; Roger L. May

[57] ABSTRACT

A door hinge unit comprises a first leaf attached to a door, a second leaf attached to a hinge pillar, a hinge pin adapted to be inserted into corresponding bores formed within the leaves of the hinge, a striker mounted to the second leaf, and a check arm mounted to the first leaf and urged into contact with the striker by means of an elastomeric element which preferably comprises a generally annular elastomeric component which may be mounted to a cylindrincal pedestal having an axial groove for accepting a shank of the check arm. The check arm may be furnished with a plurality of indentations allowing the hinge unit to be stopped in any one of several rotational positions of stable equilibrium.

7 Claims, 6 Drawing Figures

FIG. 5
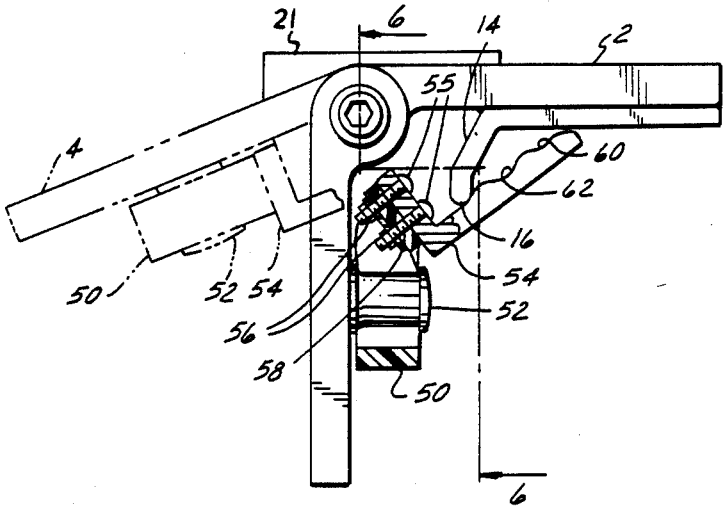
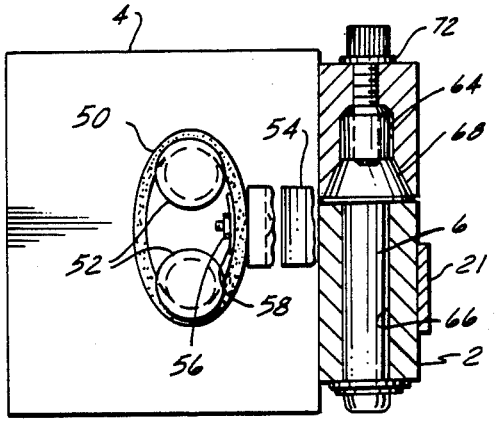
FIG. 6

DOOR HINGE WITH AN ANNULAR ELASTOMERIC CHECK

BACKGROUND OF THE INVENTION

1. Field of the Invention

This invention relates to a door hinge having an elastomerically controlled check feature.

2. Disclosure Information

Door hinge assemblies suitable for use with higher weight, manually operable doors such as those found on motor vehicles are usually equipped with a checking device allowing the door to be temporarily stopped at one or more intermediate positions in its swing from the open to the closed position and vice versa. These check devices have taken a variety of forms, the most common being that in which a spring loaded locking arm has a series of detenting depressions engageable with a roller. An example of such an arrangement is disclosed in U.S. Pat. No. 1,694,764. An example of another arrangement in which a hold open lever on one hinge member is biased into engagement with a detent roller on another hinge member by a compression spring is disclosed in U.S. Pat. No. 4,446,596. This hinge as well as the previously described unit suffers from shortcomings engendered by the use of steel springs to bias check arms or hold open levers because such springs are noisy in their operation and subject to damage from corrosion. Another disadvantage of the hinge unit disclosed in the '596 patent resides in the fact that the two hinge leaves are not readily separable. This is important in the context of automobile manufacturing inasmuch as it is frequently preferable to utilize a hinge unit which permits one leaf to be attached to the door and the second leaf to be attached to the hinge pillar of the vehicle so that only the hinge pin need be inserted to affix the door to the vehicle during the production process.

U.S. Pat. No. 3,820,192 discloses a door hinge unit including a check arm mounted and biased by means of a metallic torsion spring. This hinge unit would normally be expected to produce noise in a similar manner to other hinge units using metallic springs. There is some question, too, regarding the suitability of this hinge unit for assembly processes needing a separable hinge unit.

U.S Pat. No. 4,090,273 discloses a detent for a mechanical linkage or hinge having a four-sided rotatable cam follower abutting a spring loaded linkage. Because the cam follower rotates about a bearing pin which would be under extremely high unit loading during operation of the device, it would be expected that this system would be subject to excessive wear at the pivot which could cause malfunctions of the hinge as well as noise.

U.S. Pat. No. 4,329,759 discloses an over-center hinge for thin-walled doors of cabinets in which a molded plastic element having a tongue directly contacts one leaf in the area of its pivot so as to hold the cabinet door closed.

Finally, U.S. Pat. No. 3,000,049 discloses a plastic hinge molded of thermoplastic material and including detents formed by the hinge pintle and corresponding pivot sockets. This hinge is not susceptible to disassembly following its manufacture.

It is an object of the present invention to provide a door hinge having a check which is biased by an elastomeric element which element is easily replaced if it is damaged and which provides quiet operation for the hinge assembly.

It is a further object of the present invention to provide a check assembly in a hinge which has lift-off capability to permit ready assembly of the hinge at any time following its manufacture.

SUMMARY OF THE DISCLOSURE

The door hinge assembly comprises a first leaf adapted for attachment to a door, a second leaf adapted for attachment to a hinge pillar, a hinge pin pivotably joining the leaves and slidably disengageable therefrom, a striker mounted to the second leaf, and a check arm mounted to the first leaf and urged into contact with the striker by means of an elastomeric element. The elastomeric element preferably comprises an annular sleeve fixed to the first leaf with the check arm mounted upon the annular sleeve, or it may preferably comprise an annular element extending about the circumference of a pedestal to which the check arm is pivoted. The check arm preferably includes multiple indentations engageable with the striker for securing the hinge leaves in a plurality of rotational positions. The hinge pin is preferably adapted to be inserted into corresponding bores formed within the leaves for the purpose of allowing the hinge to be separated after its manufacture and rejoined at any subsequent time during the assembly process of the device into which the hinge is incorporated.

BRIEF DESCRIPTION OF THE DRAWINGS

FIG. 5 is a plan view of a second embodiment of the hinge of the present invention.

FIG. 6 is a side elevation of the hinge shown in FIG. 5 taken along the line 6—6 of FIG. 5.

DESCRIPTION OF THE PREFERRED EMBODIMENTS

Figure 1:
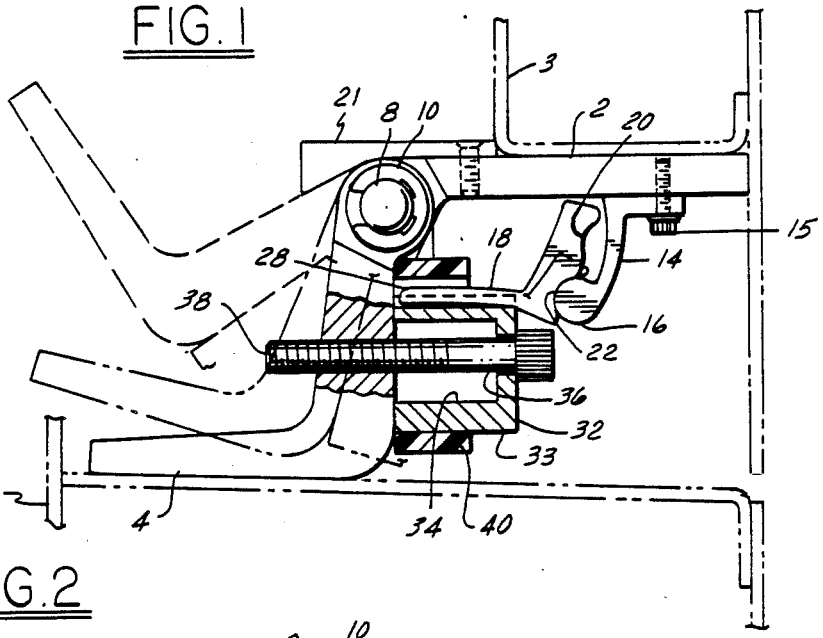
FIG. 1 is a plan view, partially cut away, of the hinge of the present invention.

As shown in FIGS. 1–4, a first embodiment of the present invention includes first leaf 4 which is adapted for attachment to door 1 and second leaf 2 which is adapted for attachment to hinge pillar 3. The leaves of the hinge assembly may be attached to the hinge pillar and door by means of conventional fasteners or by other conventional methods such as spot or fusion welding, brazing, or other known methods.

The present invention further comprises striker 14 mounted to second leaf 2. Striker 14 is preferably mounted by retaining screws 15, but could be mounted by alternative means such as welding, brazing, or other means known to those skilled in the art.

Figure 3:
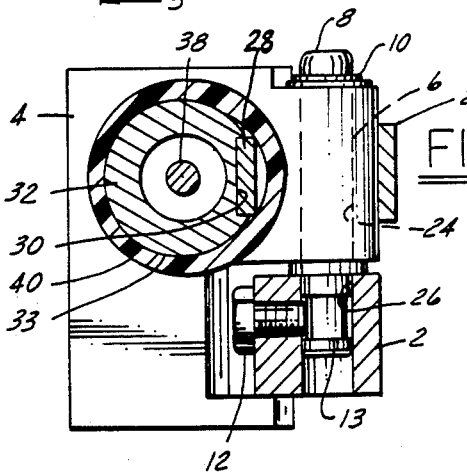
FIG. 3 is a cross section of the hinge assembly shown in FIG. 2 taken along the line 3—3 of FIG. 3.

Hinge pin 8 pivotably joins the first and second leaves. As shown in FIG. 3, hinge pin 8 is generally cylindrical and has a shank, 6, which is slidably received within bore 24 formed in the first leaf and companion bore 26 formed in the second leaf. Hinge pin 8 is surmounted by a head having washer 10 entered into an annular groove formed within the hinge pin (groove is not shown) in a conventional manner. Hinge pin 8 is retained within the hinge assembly by cap screw 12 which is seated within a retaining groove 13 formed in shank 6. Thus, the hinge pin serves to pivotably join the leaves. The pin may be inserted at any time following manufacture of the hinge and this permits the hinge to be separated and the individual leaves attached to components manufactured at various sites for later assembly into one unit. Because the hinge of the present invention allows its reunion to occur by means of insertion of pin 8, this hinge is ideally suited for assembly processess such as automobile manufacturing in which the components joined by the hinges may be constructed at differing locations and reunited on a moving assembly line, for example.

Check arm 18 is pivotably mounted to pedestal 32. The pedestal has a generally cylindrical outer diameter 33 into which is formed a groove 30 for accepting shank 28 of check arm 18. Check arm 18 is maintained in contact with pedestal 32 and the sides of groove 30 by means of annular elastomeric element 40 which comprises an annular sleeve extending about the circumference of the pedestal and the shank of check arm 18 so as to resiliently urge check arm 18 into contact with groove 30 and with striker 14. Although the check arm is shown in FIGS. 1–3 as being mounted to the movable leaf, the positions of the check arm and striker could be reversed, with the striker mounted upon the movable leaf and the check arm mounted upon the stationary leaf.

Figure 2:
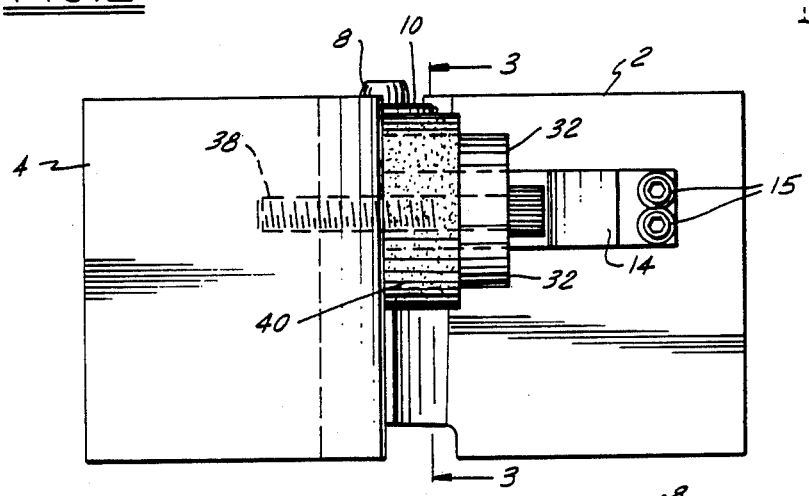
FIG. 2 is a side elevation of the hinge shown in FIG. 1.
Figure 4:
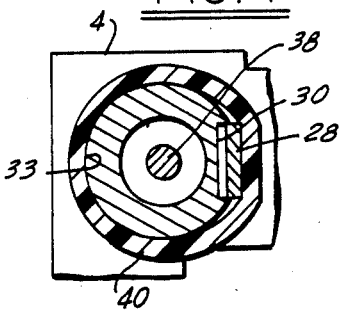
FIG. 4 is a partial view of the hinge shown in FIG. 3 with the check arm in a detented position.

As shown in FIG. 1, striker 14 has a rounded tip 16, which mates with distal detent 20 and proximal detent 22 formed within check arm 18. As shown in the Figures, annular elastomeric element 40 urges check arm shank 28 into contact with groove 30. As a result, check arm 18 is urged into contact with the striker 14. As the check arm is moved along the striker during opening or closing of the door, the annular elastomeric element is deformed as shown in FIG. 4 and this deformation accommodates the pivotal motion of the check arm upon pedestal 32. The pedestal is held in rigid contact with second leaf 4 by means of cap screw 38 which runs through bore 34 and hole 36 formed within pedestal 32.

Abutment 21 is fixed to second leaf 2 and serves to prevent any further opening of door 1 once the hinge assembly has reached the rotational position shown by the wholly dashed lines in FIG. 1. Abutment 21 would preferably comprise a weldment or bolted structure, but could be integral with leaf 2.

The hinge assembly of the present invention offers several important advantages. First, the lift off feature of the hinge allows, as previously noted, this hinge to be used in assembly processes in which the mating components are manufactured in various areas and joined at the assembly line. Second, the elastomeric element is easily replaced in the event that it becomes excessively worn. A further advantage resides in the fact that the damping inherent in the elastomeric element assures that the hinge of the present invention will operate quietly by merely sliding the worn elastomeric element from the pedestal and then sliding a new sleeve onto the pedestal. A further advantage stems from the fact that the elastomeric element is impervious to corrosion, a condition often prevailing with ferrous and even nonferrous components used in construction of automobiles and other machines. Yet another advantage resides in the fact that the efforts required to move the door against the stop mechanism may easily be adjusted by substituting a replacement elastomeric element having different elastomeric properties. Such substitution will not involve the expense normally associated with the tooling of metal parts.

When the hinge assembly of the present invention is rotated, the striker and check arm allow the hinge to be positioned in two rotational positions characterizable as stable equilibrium. These positions of stable equilibrium occur when striker tip 16 is mated with one of the proximal or distal detents formed within the check arm. When the striker tip is within a detent, additional effort will be required to rotate the hinge from this position because elastomeric element 40 will tend to urge the check arm to maintain contact with the striker tip and the operator of the hinge will thus be required to stretch the elastomeric element so as to permit the check arm to ride over the striker tip from one detent to the other. In view of this disclosure those skilled in the art will recognize that the check arm could have a greater or a lesser number of detents depending upon the particular usage of the present hinge.

FIGS. 5 and 6 show a second preferred embodiment of the present invention in which annular elastomeric element 50 is retained on first leaf 4 by means of retainers 52 comprising generally cylindrical posts having heads 53 which capture the elastomeric element and clamp it to leaf 4. Check arm 54 is mounted upon annular sleeve 50 by means of bolts 55 and nuts 56 which run through the check arm and through the elastomeric element as well. Backup plate 58 is provided to reinforce the attachment of the check arm to the elastomeric element. Check arm 54, as before, has two detents, proximal detent 62 and distal detent 60 and functions in the manner ascribed to the previous embodiment. Hinge pin 6 is retained within bore 66 formed within first leaf 4 and bore 64 formed within second leaf 2 by retaining screw 72. Hinge pin 6 has a conical section 68 which supports the hinge leaf 4, thus permitting the leaves to be assembled following their attachment to the components intended to be ultimately joined by the hinge assembly.

As is readily discernible from the foregoing disclosure, elastomeric element 50 of the second embodiment functions not only as a pedestal for supporting check arm 54 but also as a spring element for urging check arm 54 into contact with striker 14. Elastomeric element 50 thus combines the functions of pedestal 32 and elastomeric element 40 of the first embodiment.

The strikers and check arms of each of the embodiments of the invention are preferably comprised of molded or machined or stamped ferrous or nonferrous metals or plastics or plastic composite materials which will be suggested by this disclosure to those skilled in the art. The elastomeric element is preferably comprised of a material such as oriented polyester polyether. This compound is sold under the name Hytrel by E.I. duPont de Nemours, Inc. Other elastomeric materials for the elastomeric element will be suggested by this disclosure.

The invention has thus been shown and described with reference to specific embodiments; however, it should be noted that the invention is in no way limited to the details of the illustrated structure, but changes and modifications may be made without departing from the scope of the appended claims.

I claim:

1. A door hinge assembly comprising:

a first leaf adapted for attachment to a door;

a second leaf adapted for attachment to a hinge pillar;

a hinge pin pivotably joining said leaves;

a striker mounted to one of said leaves; and a check arm mounted to the other of said leaves and urged into contact with said striker by means of an elastomeric element, with said elastomeric element comprising an annular sleeve fixed to one of said leaves, with said check arm mounted upon said annular sleeve.

2. The door hinge assembly according to claim 1 wherein said check arm has multiple indentations engageable with said striker for securing said hinge leaves in a plurality of rotational positions with respect to each other.

3. A door hinge assembly comprising:

a first leaf adapted for attachment to a door;

a second leaf adapted for attachment to a hinge pillar;

a hinge pin pivotably joining said leaves;

a striker mounted to said second leaf;

a check arm having multiple indentations for engaging said striker; and means for pivotably mounting said check arm to said first leaf wherein said means comprises a pedestal attached to said first leaf and an annular elastomeric sleeve extending about the circumference of said pedestal for maintaining said check arm in direct contact with said pedestal and with said striker.

4. The door hinge assembly according to claim 3 wherein said check arm has a generally rectangular cross section at least in that portion of said arm which is in contact with said pedestal.

5. The door hinge assembly according to claim 4 wherein said pedestal has an external groove sized to accept said check arm.

6. The door hinge assembly according to claim 5 wherein said check arm is maintained in contact with said groove of said pedestal by means of said elastomeric sleeve.

7. The door hinge assembly according to claim 6 further comprising an abutment fixed to said first leaf which abutment contacts said second leaf when said hinge has been opened to a predetermined extent, whereby said abutment will prevent further opening of said hinge.

* * * * *